US008506879B2

(12) United States Patent
Ueoka et al.

(10) Patent No.: US 8,506,879 B2
(45) Date of Patent: Aug. 13, 2013

(54) METHOD FOR COOLING HOT STRIP

(75) Inventors: Satoshi Ueoka, Fukuyama (JP); Akio Fujibayashi, Fukuyama (JP); Naoki Nakata, Fukuyama (JP); Takashi Kuroki, Fukuyama (JP); Shougo Tomita, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/565,114

(22) Filed: Aug. 2, 2012

(65) Prior Publication Data

US 2012/0291804 A1 Nov. 22, 2012

Related U.S. Application Data

(62) Division of application No. 12/083,043, filed as application No. PCT/JP2006/322789 on Nov. 9, 2006, now Pat. No. 8,318,080.

(30) Foreign Application Priority Data

Nov. 11, 2005 (JP) ..... 2005-326843

(51) Int. Cl.

| | |
|---|---|
| ***C21D 9/54*** | (2006.01) |
| *C21D 1/00* | (2006.01) |
| *C21D 9/00* | (2006.01) |
| *C21B 7/10* | (2006.01) |
| *B21B 27/06* | (2006.01) |
| *B21D 31/00* | (2006.01) |

(52) U.S. Cl.
USPC ..... 266/113; 72/201; 72/364; 286/46; 286/114

(58) Field of Classification Search
USPC ..... 72/201, 364; 266/46, 113, 114
See application file for complete search history.

(56) References Cited

U.S. PATENT DOCUMENTS

| | | | |
|---|---|---|---|
| 4,507,949 | A | 4/1985 | Killea |
| 5,697,169 | A | 12/1997 | Jacob |
| 6,733,720 | B2 | 5/2004 | Fujibayashi et al. |
| 8,231,826 | B2 | 7/2012 | Ueoka et al. |
| 2009/0019907 | A1 | 1/2009 | Ueoka et al. |

FOREIGN PATENT DOCUMENTS

| | | | |
|---|---|---|---|
| JP | 61-012829 | A | 1/1986 |
| JP | 09-141322 | A | 6/1997 |
| JP | 10-166023 | A | 6/1998 |
| JP | 10-249429 | A | 9/1998 |
| JP | 11-138207 | A | 5/1999 |
| JP | 2001-1286925 | A | 10/2001 |
| JP | 2001-353515 | A | 12/2001 |
| JP | 2002-239623 | A | 8/2002 |

(Continued)

OTHER PUBLICATIONS

International Search Report (in English) for PCT/JP2006/322789 dated Feb. 7, 2007.

(Continued)

*Primary Examiner* — Keith Walker
*Assistant Examiner* — Alexander Polyansky
(74) *Attorney, Agent, or Firm* — Holtz Holtz Goodman & Chick PC

(57) ABSTRACT

A method for cooling a hot strip conveyed on a run-out table after finishing, including ejecting rod-like flows of cooling water from nozzles to the upper surface of the steel strip such that the flows are inclined toward a traveling direction of the steel strip, and draining the cooling water using draining means disposed downstream of the nozzles.

7 Claims, 3 Drawing Sheets

(56) References Cited

FOREIGN PATENT DOCUMENTS

| | | | |
|---|---|---|---|
| JP | 2003-191005 | A | 7/2003 |
| JP | 2004-330237 | A | 11/2004 |
| JP | 2005-059038 | A | 3/2005 |
| JP | 2006-035233 | A | 2/2006 |
| WO | WO 91/04109 | A1 | 4/1991 |

OTHER PUBLICATIONS

Supplementary European Search Report dated Oct. 27, 2011 in the corresponding EP application 06 82 3437.

Berger B. et al., "20-H Mill for Maximum Production and Quality," Aise Steel Technology, *Iron and Steel Engineer*, vol. 69, No. 11, Nov. 1, 1992, pp. 25 to 31, Pittsburgh, PA, US.

U.S. Appl. No. 13/471,552, Confirmation No. 7414.

METHOD FOR COOLING HOT STRIP

CROSS-REFERENCE TO RELATED APPLICATIONS

This application is a divisional application of application Ser. No. 12/083,043 filed Apr. 3, 2008 (U.S. Pat. No. 8,318,080), which is the United States national phase application under 35 USC 371 of International application PCT/JP2006/322789 filed Nov. 9, 2006. The entire contents of each of application Ser. No. 12/083,043 and International application PCT/JP2006/322789 are hereby incorporated by reference herein.

TECHNICAL FIELD

The present invention relates to devices and methods for cooling hot-rolled steel strips.

BACKGROUND ART

In order to produce hot strips, in general, slabs are heated to a predetermined temperature in heating furnaces, and the heated slabs are rolled into rough bars having a predetermined thickness in roughing stands. Subsequently, the rough bars are rolled into steel strips having a predetermined thickness in continuous finishing stands including a plurality of rolling stands. After the steel strips are cooled by cooling devices on run-out tables, the strips are coiled by down coilers.

In order to cool the upper sides of the steel strips, the cooling devices on the run-out tables for continuously cooling hot-rolled steel strips pour laminar flows of cooling water from laminar flow nozzles of the round type onto roller tables for conveying steel strips linearly over the width of the roller tables. On the other hand, in order to cool the lower sides of the steel strips, spray nozzles are disposed between two adjacent roller tables in general so as to eject cooling water.

However, in such known cooling devices, the flows of the cooling water from the laminar flow nozzles used for cooling the upper sides of the steel strips are free-fall flows. This can cause problems such as variation in cooling capacity in accordance with the existence of water remaining on the upper surfaces of the steel strips since it is difficult for the cooling water to reach the steel strips when water films of the remaining water exist on the upper surfaces of the steel strips and unstable cooling capacity in response to changes in cooling areas (cooling zones) caused when the cooling water falling on the steel strips freely expands in all directions. As a result of the variation in the cooling capacity, the properties of the steel strips easily become uneven.

In order to achieve a stable cooling capacity by draining the cooling water (remaining water) on the upper surfaces of the steel strips, a method for discharging remaining water by ejecting fluid obliquely across upper surfaces of steel strips (for example, Patent Document 1) and a method for damming up remaining water using a restraining roller for restraining vertical movement of steel strips as a draining roller so as to stabilize cooling areas (for example, Patent Document 2) have been proposed.

Herein, Patent Document 3 is also described below since the document is cited in the section of "Best Modes for Carrying Out the Invention".

Patent Document 1: Japanese Unexamined Patent Application Publication No. 9-141322

Patent Document 2: Japanese Unexamined Patent Application Publication No. 10-166023

Patent Document 3: Japanese Unexamined Patent Application Publication No. 2002-239623

DISCLOSURE OF INVENTION

However, according to the method described in Patent Document 1, a larger volume of cooling water remains downstream, and the draining effect is reduced downstream. Moreover, according to the method described in Patent Document 2, the draining effect by the restraining roller (draining roller) does not operate on the leading ends of the steel strips since the leading ends of the steel strips are conveyed without being restrained by the restraining roller after the leading ends of the steel strips come out of finishing stands until reaching a down coiler.

Furthermore, since the leading ends of the steel strips pass over a run-out table while being vertically undulated, cooling water supplied to the upper surfaces of the leading ends of the steel strips tends to selectively remain in bottom portions of the undulated parts. As a result, a cooling temperature hunting phenomenon (oscillatory variation) takes place until the undulation is removed when the leading ends of the steel strips are coiled by the down coiler and the steel strips are held under tension. This cooling temperature hunting phenomenon also causes variation in the mechanical properties of the steel strips.

The present invention is produced with consideration of the above-described circumstances. It is an object of the present invention to provide a device and a method for cooling a hot strip capable of uniformly cooling the hot-rolled steel strip from the leading end to the trailing end thereof by realizing a high cooling capacity and a stable cooling area during cooling of the steel strip using cooling water.

To solve the above-described problems, the present invention has the following features.

[1] A device for cooling a hot strip conveyed on a run-out table after finishing, includes:

a plurality of cooling nozzles that eject rod-like flows of cooling water to the upper surface of the steel strip such that the ejecting angle is inclined toward a traveling direction of the steel strip; and draining means disposed downstream of the cooling nozzles for draining the cooling water ejected from the cooling nozzles and remaining on the upper surface of the steel strip.

[2] The device for cooling a hot strip according to [1] is characterized in that:

the plurality of cooling nozzles are disposed in lines extending in the width direction of the steel strip, and the lines are disposed in the traveling direction of the steel strip; and the positions of the cooling nozzles disposed in downstream lines are shifted from the positions of the cooling nozzles disposed in corresponding upstream lines in the width direction.

[3] The device for cooling a hot strip according to [1] or [2] is characterized in that an angle formed between the steel strip and the rod-like flows of cooling water ejected from the cooling nozzles is 60° or less.

[4] The device for cooling a hot strip according to [2] or [3] is characterized in that ejection of the cooling water from the lines of the cooling nozzles can be independently on-off controlled in control units of one or more lines.

[5] The device for cooling a hot strip according to any one of [1] to [4] is characterized in that the draining means is a rotatable and liftable pinch roller so as to come into contact with the steel strip while being rotated.

[6] The device for cooling a hot strip according to any one of [1] to [4] is characterized in that the draining means is one or more nozzle lines that eject fluid for drainage from slit-shaped or circular nozzle outlets such that the ejecting angle is inclined upstream in the traveling direction of the steel strip.

[7] A method for cooling a hot strip conveyed on a run-out table after finishing, includes:

ejecting rod-like flows of cooling water from nozzles to the upper surface of the steel strip such that the flows are inclined toward a traveling direction of the steel strip; and draining the cooling water using draining means disposed downstream of the nozzles.

[8] The method for cooling a hot strip according to [7] is characterized in that the length of a cooling zone is changed such that the cooling capacity is controlled by controlling the number of nozzle lines in the traveling direction of the steel strip, the nozzle lines ejecting the rod-like flows of cooling water.

[9] The method for cooling a hot strip according to [7] or [8] is characterized in that:

the draining means is a pinch roller, a gap under the pinch roller is set so as to correspond to the thickness of the steel strip or less in advance, and ejection of the cooling water is started substantially at the same time as when the leading end of the steel strip is nipped by the pinch roller; and the pinch roller is slightly lifted while the pinch roller is rotated substantially at the same time as when the leading end of the steel strip is taken up into a coiler.

[10] The method for cooling a hot strip according to [8] is characterized in that the draining means are nozzles that eject fluid for drainage from slit-shaped or circular nozzle outlets inclined upstream in the traveling direction of the steel strip, and at least one of the volume of water, the water pressure, and the number of nozzle lines of the ejecting nozzles that eject the fluid for drainage is changed in accordance with the number of lines of the ejecting nozzles that eject the rod-like flows of cooling water inclined toward the traveling direction of the steel strip.

[11] The method for cooling a hot strip according to any one of Claims [8] to [10] is characterized in that the nozzle lines that eject the rod-like flows of cooling water inclined toward the traveling direction of the steel strip are preferentially used from the lines adjacent to the draining means, and the length of the cooling zone is changed by successively turning on or off the upstream nozzle lines during the control of the number of nozzle lines in the traveling direction of the steel strip.

According to the present invention, the steel strip can be uniformly cooled from the leading end to the trailing end thereof, and the properties of the steel strip can be stabilized. With this, cutoff portions of the steel strip can be reduced, resulting in an improvement in the yield.

BRIEF DESCRIPTION OF DRAWINGS

FIGS. 8A and 83 illustrate arrangements of nozzles for ejecting rod-like flows of cooling water in cooler bodies according to the first and second embodiment of the present invention and draining means according to the second embodiment in detail.

Figure 1:
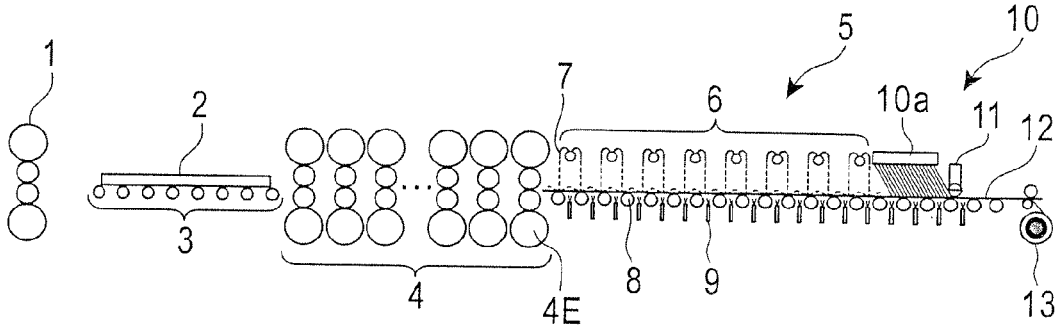
FIG. 1 illustrates a configuration of a rolling facility according to first and second embodiments of the present invention.

Reference numbers in the drawings indicate the followings.

1 roughing stand
2 rough bar
3 table rollers
4 group of continuous finishing stands
4E last finishing stand
5 run-out table
6 cooling device
7 laminar flow nozzles
8 table rollers
9 spray nozzles
10 cooling device
10*a* cooler body
10*b* cooler body
11 pinch roller
12 steel strip
13 down coiler
14 nozzle headers for cooling water
15 tubular nozzles
16 cooling-water supply pipes
17 cooling device of proximity type
18 pinch roller
19 ejecting nozzles for ejecting rod-like flows of cooling water serving as draining means

BEST MODES FOR CARRYING OUT THE INVENTION

Embodiments of the present invention will now be described with reference to the drawings.

FIG. 1 illustrates a facility for producing hot strips according to a first embodiment of the present invention.

A rough bar 2 rolled by a roughing stand 1 is conveyed on table rollers 3, and continuously rolled into a steel strip 12 having a predetermined thickness by a group of seven continuous finishing stands 4. After this, the steel strip 12 is guided to a run-out table 5 constituting a strip-conveying path downstream of a last finishing stand 4E. This run-out table 5 has a total length of about 100 m, and cooling devices are disposed on parts of or most parts of the run-out table 5. After the steel strip 12 is cooled on the run-out table 5, the steel strip 12 is coiled by a downstream down coiler 13 so as to be a hot-rolled coil.

In this embodiment, a known cooling device 6 and a cooling device 10 according to the present invention are disposed in this order as cooling devices for cooling the upper side of the steel strip provided for the run-out table 5. The known cooling device 6 includes a plurality of laminar flow nozzles 7 of the round type disposed above the upper surface of the run-out table 5 at a predetermined pitch for supplying free-fall flows of cooling water to the steel strip. Moreover, a plurality of spray nozzles 9 are disposed between table rollers 8 for conveying the steel strip as a cooling device for cooling the lower side of the steel strip.

Figure 2:
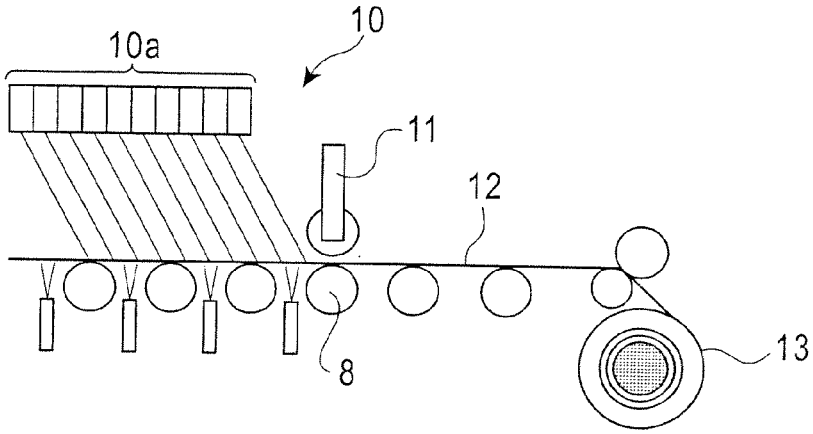
FIG. 2 illustrates the structure of a cooling device according to the first embodiment of the present invention.

FIG. 2 illustrates a configuration in the vicinity of the cooling device 10 according to the first embodiment of the present invention. The cooling device 10 includes a cooler body 10*a* (described below) disposed above the upper surface of the run-out table 5 and a pinch roller 11 serving as draining means disposed downstream of the cooler body. The configuration adjacent to the lower surface of the steel strip is similar to that of the known cooling device 6, and, for example, the rotatable table rollers 8 for conveying the steel strip having a diameter of 350 mm are disposed adjacent to the lower surface of the steel strip 12 at a pitch of about 400 mm in a strip-traveling direction.

Figure 3:
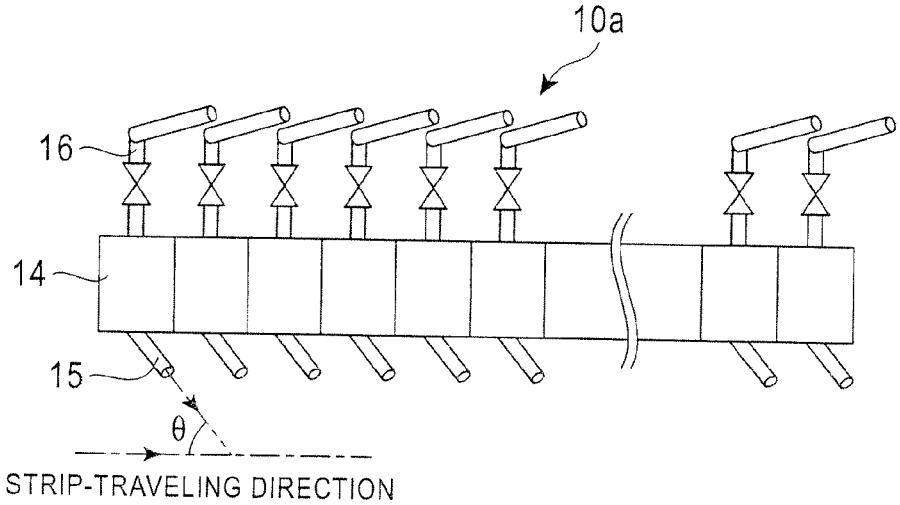
FIG. 3 illustrates the cooling device according to the first embodiment of the present invention in detail.

FIG. 3 illustrates the structure of the cooler body 10*a*. That is, tubular nozzles 15 are aligned in the width direction of the steel strip at a predetermined pitch (for example, 60 mm), and the tubular nozzles 15 of a predetermined number of lines (for example, 100 lines) are attached to nozzle headers 14 for cooling water at a predetermined pitch (for example, 100 mm) in the strip-traveling direction. Herein, the tubular nozzles 15 in each line are connected to a cooling-water supply pipe 16 via one nozzle header 14, and the cooling-water supply pipes 16 can be independently on-off controlled.

The tubular nozzles 15 are straight-pipe nozzles having a predetermined inner diameter (for example, 8 mm) and smooth inner surfaces, and supply rod-like flows of cooling water. The tubular nozzles 15 are inclined so as to eject the rod-like flows of cooling water at a predetermined ejecting angle θ (for example, θ=50°) with respect to the traveling direction of the steel strip 12. Moreover, outlets of the tubular nozzles 15 are separated from the upper surface of the steel strip 12 by a predetermined distance (for example, 1,000 mm) such that the steel strip 12 does not come into contact with the tubular nozzles 15 even when the steel strip 12 vertically moves.

Herein, the rod-like flows of cooling water according to the present invention indicate cooling water ejected from circular (including elliptical and polygonal) outlets of nozzles while the cooling water is pressurized to some extent. The ejecting speed of the cooling water from the outlets of the nozzles is 7 m/s or more, and the flows of cooling water are continuous and rectilinear so as to have cross sections that are kept substantially circular after the flows are ejected from the outlets of the nozzles until hitting the steel strip. That is, the rod-like flows differ from free-fall flows discharged from laminar flow nozzles of the round type and those ejected in a droplet state such as in the case of spray.

On the other hand, the pinch roller 11 serving as the draining means has a predetermined size (for example, a diameter of 250 mm), and is disposed over one of the table rollers 8 downstream of the cooler body 10*a* such that the steel strip 12 is nipped between the pinch roller 11 and the opposing table roller. The pinch roller 11 is rotatable and liftable so as to come into contact with the steel strip 12 while being rotated, and the height thereof can be optionally changed. The gap between the pinch roller 11 and the opposing table roller 8 is set so as to be less than the thickness of the steel strip 12 (for example, thickness minus 1 mm) in advance, and ejection of the cooling water from the tubular nozzles 15 is started at the same time as when the leading end of the steel strip 12 coming out of the finishing stands is nipped by the pinch roller 11. Moreover, a driving motor (not shown) for rotating the pinch roller 11 disposed adjacent to the pinch roller 11 is connected to the pinch roller 11. The rotational speed of the pinch roller 11 is adjusted by the driving motor so as to be matched to the conveying speed of the steel strip 12. In addition, the positions of the cooler body 10*a* and the pinch roller 11 are adjusted such that the cooling water ejected from the tubular nozzles in the last line (the most downstream line) reaches the steel strip 12 at a position upstream of the position where the pinch roller 11 comes into contact with the steel strip 12 while being rotated.

According to this embodiment, the cooling device 10 includes the plurality of tubular nozzles 15 inclined so as to eject the rod-like flows of cooling water at the ejecting angle θ with respect to the traveling direction of the steel strip 12 and the pinch roller 11 disposed downstream of the tubular nozzles 15 and nipping the steel strip 12 between the pinch roller 11 and the opposing table roller 8 as described above. Thus, the cooling water (remaining water) supplied from the tubular nozzles 15 to the upper surface of the steel strip 12 flows in the traveling direction of the steel strip 12, and the flow of the remaining water is dammed up by the pinch roller 11. With this, the cooling area cooled by the cooling water can be stabilized. In addition, since the rod-like flows of cooling water are ejected from the tubular nozzles 15, a film of the water remaining on the upper surface of the steel strip 12 can be broken, and fresh cooling water can reach the steel strip 12.

In known technologies, the leading end of the steel strip is undulated, and cooling water selectively remains in bottom portions of the undulated parts, resulting in overcooling. In this embodiment, the draining means can prevent the remaining water from flowing outside the water-cooling devices (downstream of the draining means).

As a result, problems such as variation in cooling capacity in accordance with the existence of the water remaining on the upper surface of the steel strip and unstable cooling capacity in response to changes in the cooling area caused when the cooling water falling on the steel strip freely expands in all directions as in the known cooling device using free-fall flows discharged from the laminar flow nozzles are solved, and a high and stable cooling capacity can be achieved regardless of the shape of the steel strip. For example, a steel strip having a thickness of 3 mm can be rapidly cooled at a cooling speed of more than 100° C./s.

In the above description, the angle θ formed between the steel strip 12 and the rod-like flows of cooling water ejected from the tubular nozzles 15 is preferably set to 60° or less. When the angle θ exceeds 60°, the velocity component of the cooling water (remaining water) in the strip-traveling direction after the cooling water reaches the steel strip 12 becomes small. With this, the cooling water can interfere with the remaining water ejected from the downstream lines, and the flow of the remaining water can be obstructed. This can lead to an outflow of part of the remaining water to a position upstream of the position where the rod-like flows of cooling water ejected from the tubular nozzles 15 in the most upstream line reach (hit) the steel strip, and can lead to instability of the cooling area. Therefore, the angle θ is preferably set to 60° or less so that the cooling water that have reached the steel strip 12 reliably flows in the strip-traveling direction, and more preferably, the angle θ is set to 50° or less. However, when the angle θ is set so as to be less than 30° while the height from the steel strip 12 is kept to a predetermined value, the distance from the tubular nozzles 15 to the position where the rod-like flows of cooling water reach (hit) the steel strip becomes too long. This can cause dispersion of the rod-like flows of cooling water and degradation of cooling characteristics. Thus, the angle θ formed between the steel strip 12 and the rod-like flows of cooling water is preferably set so as to be 30° or more.

The reason why the tubular nozzles 15 for forming the rod-like flows of cooling water are adopted as cooling-water nozzles in the present invention is as follows. That is, in order to reliably cool the steel strip, cooling water needs to reliably reach and hit the steel strip. To this end, the film of the water remaining on the upper surface of the steel strip 12 needs to be broken such that fresh cooling water reaches the steel strip 12, and the flows of the cooling water need to be continuous and rectilinear so as to have a high penetration unlike clusters of droplets ejected from spray nozzles having a low penetration. Furthermore, since laminar flows discharged from the known laminar flow nozzles are free-fall flows, it is difficult for the cooling water to reach the steel strip when a film of remaining water exists. In addition, there are problems in that the cooling capacity varies in accordance with the existence of the remaining water, and that the cooling capacity varies in response to changes in the speed of the steel strip since the water falling on the steel strip expands in all directions. Therefore, the tubular nozzles 15 (including those having elliptical or polygonal cross sections) are used in the present invention so as to eject the cooling water from the outlets of the nozzles at an ejecting speed of 7 m/s or more and so as to eject the continuous and rectilinear rod-like flows of cooling water having cross sections that are kept substantially circular after the flows are ejected from the outlets of the nozzles until hitting the steel strip. When the speed of the rod-like flows of cooling water ejected from the outlets of the nozzles is 7 m/s or more, the film of the water remaining on the upper surface of the steel strip can be stably broken even when the cooling water is obliquely ejected.

Slit-shaped nozzles can be used instead of the tubular nozzles 15. However, when the aperture of the nozzles is set such that the nozzles are not clogged (3 mm or more in reality), the cross-sectional area of the nozzles is significantly increased compared with the case where the tubular nozzles 15 are aligned in the width direction of the steel strip with a spacing therebetween. Therefore, when the cooling water is ejected from the outlets of the nozzles at an ejecting speed of 7 m/s or more so as to penetrate the water film of the remaining water, a huge volume of water is required. This leads to a considerable increase in equipment cost, and it is difficult to realize.

The thickness of the rod-like flows of cooling water is desirably a several millimeters, and at least 3 mm. When the thickness is less than 3 mm, it is difficult for the cooling water to break the water remaining on the steel strip and hit the steel strip.

Moreover, in view of preventing the outflows of the cooling water hitting the steel strip to a position upstream in the strip-traveling direction, the velocity component of the rod-like flows of cooling water in the strip-traveling direction when the cooling water hits the steel strip 12 is desirably set so as to correspond to the traveling speed of the steel strip 12 (for example, 10 m/s) or more.

Figure 7:
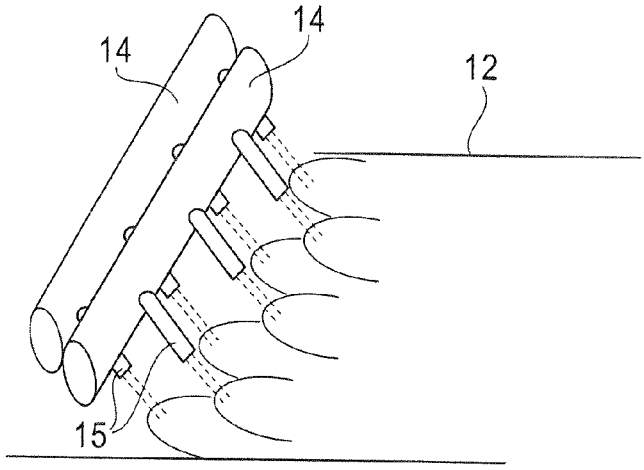
FIG. 7 illustrates hitting positions of cooling water from the cooling devices according to the present invention.
Figure 8A:
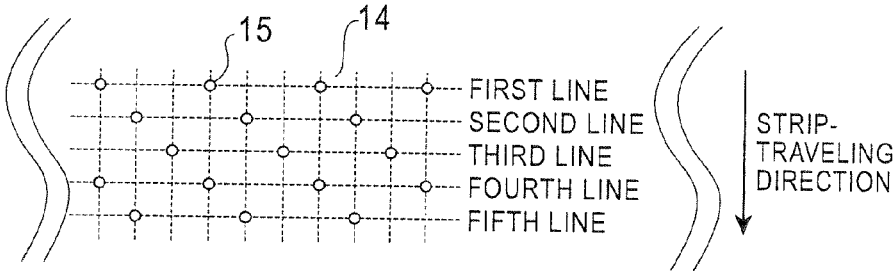

Furthermore, the positions of the tubular nozzles 15 are preferably adjusted such that the positions where the rod-like flows of cooling water ejected from posterior (downstream) lines hit the steel strip are shifted from those where the rod-like flows of cooling water ejected from corresponding anterior (upstream) lines hit the steel strip in the width direction as shown in FIG. 7. For example, the nozzles in the posterior lines can be disposed at the same intervals as those in the anterior lines in the width direction, and the posterior lines can be shifted from the corresponding anterior lines in the width direction by one-third of the interval as shown in FIG. 8A. Furthermore, the nozzles in the posterior lines can be disposed at intermediate positions between those in the corresponding anterior lines as shown in FIG. 85. With this, the rod-like flows of cooling water ejected from the posterior lines hit portions between two adjacent rod-like flows in the width direction, at which the cooling capacity is reduced, and complement the cooling area so as to achieve uniform cooling in the width direction.

As described above, the gap between the pinch roller 11 and the opposing table roller 8 is set so as to be less than the thickness of the steel strip 12 (for example, thickness minus 1 mm) in advance, and ejection of the cooling water from the tubular nozzles 15 is started at the same time as when the leading end of the steel strip 12 coming out of the finishing stands is nipped by the pinch roller 11 in this cooling device 10. However, when the steel strip is thick (for example, 2 mm or more), the leading end of the steel strip can pass through a portion where cooling water is being ejected in advance. With this, the steel strip 12 can be reliably cooled from the leading end thereof. Moreover, when the steel strip 12 is thin and passage of the steel strip 12 can be instable due to the effect of the cooling water, cooling water can be ejected at an ejecting pressure that does not obstruct the passage of the leading end of the steel strip 12, and the ejecting pressure can be changed to a predetermined value after the leading end of the steel strip is nipped by the pinch roller 11. When the leading end of the steel strip 12 is coiled by the down coiler 13 and the steel strip is held under tension, the pinch roller 11 is slightly lifted (for example, to the thickness plus 1 mm) while being rotated such that the gap becomes larger than or equal to the thickness of the steel strip 12. Even in this state, almost no cooling water on the steel strip 12 passes downstream through the pinch roller 11, and the pinch roller 11 can achieve a high draining performance. In the description above, the pinch roller 11 is slightly lifted so that scratches and loosening of the steel strip caused by a subtle disparity between the rotational speed of the pinch roller and the traveling speed of the steel strip are prevented.

Ejection of the cooling water is adjusted as follows on the basis of the traveling speed, temperature, and the like of the steel strip 12. First, the length of the cooling zone, that is, the number of lines of the tubular nozzles 15 that eject the rod-like flows of cooling water is determined on the basis of the traveling speed of the steel strip 12, the measured temperature of the steel strip 12, and an amount of temperature to be cooled to a target cooling stop temperature. The tubular nozzles 15 of the determined number of lines adjacent to the pinch roller 11 are set so as to preferentially eject the cooling water. After this, the number of lines of the tubular nozzles 15 that eject the cooling water is changed on the basis of results of temperature of the steel strip 12 after cooling with consideration of changes (acceleration or deceleration) of the traveling speed of the steel strip 12. The length of the cooling zone is desirably changed by changing the number of nozzle lines such that the nozzle lines adjacent to the pinch roller 11 are always used for ejection, and the upstream nozzle lines (adjacent to the finishing stands) are successively turned on or off.

The major role of the pinch roller 11 is to dam up the cooling water ejected from the cooler body 10*a* such that the cooling area cooled by the cooling water becomes uniform. Therefore, as described in a second embodiment of the present invention, the draining means is not limited to the above-described pinch roller 11, and various units can be used as long as the units can drain the cooling water on the upper surface of the steel strip ejected from the tubular nozzles 15.

Next, a case where nozzles for ejecting fluid for drainage, in particular, nozzles for ejecting rod-like flows of cooling water serving as the draining means are provided instead of the pinch roller 11 in the first embodiment will be described as the second embodiment of the present invention. The rod-like flows of cooling water serving as the draining means are not intended to be used for cooling. However, similar to the rod-like flows of cooling water ejected from the tubular nozzles 15 in the first embodiment, cooling water is ejected in a pressurized state such that the flows are made continuous and rectilinear and have cross sections that are kept substantially circular after the flows are ejected from the outlets of the nozzles until hitting the steel strip. Thus, the flows are referred to as "rod-like flows of cooling water".

Figure 4:
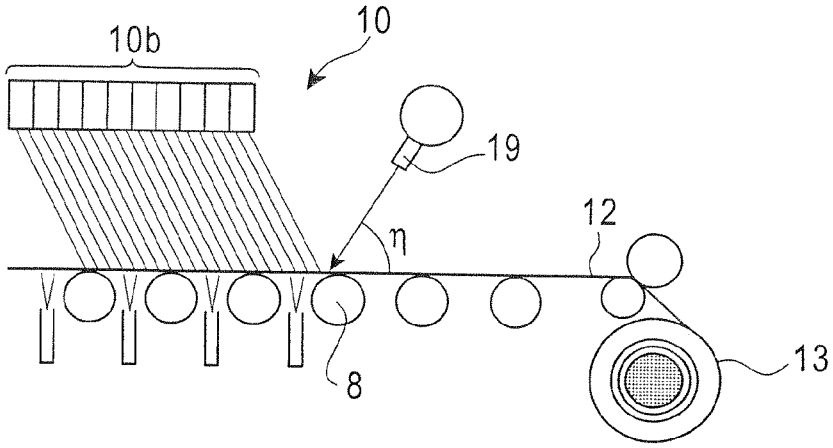
FIG. 4 illustrates the structure of a cooling device according to the second embodiment of the present invention.

The configuration of the facility for producing hot strips according to the second embodiment is substantially the same as that of the first embodiment shown in FIG. 1. However, the configuration in the vicinity of a cooling device 10 according to the second embodiment is different as shown in FIG. 4. That is, the cooling device 10 includes a cooler body 10*b* (described below) disposed above the upper surface of a run-out table 5 and ejecting nozzles 19 for ejecting rod-like flows of cooling water serving as draining means disposed downstream of the cooler body. The configuration adjacent to the lower surface of the steel strip is similar to that of the first embodiment.

Figure 6:
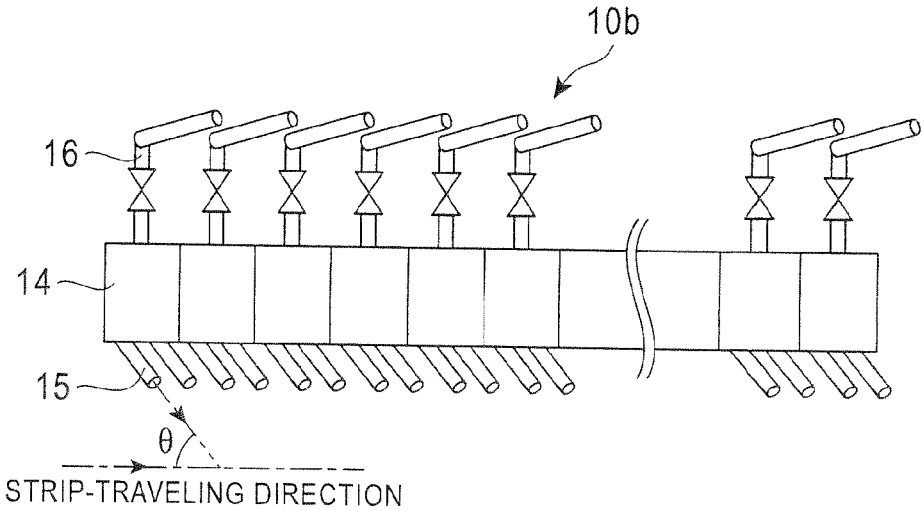
FIG. 6 illustrates the structure of the cooling device according to the second embodiment of the present invention.

FIG. 6 illustrates the structure of the cooler body 10*b*. As in the cooler body 10*a* according to the first embodiment, tubular nozzles 15 are aligned in the width direction of the steel strip at a predetermined pitch (for example, 60 mm), and the tubular nozzles 15 of a predetermined number of lines (for example, 100 lines) are attached to nozzle headers 14 for cooling water at a predetermined pitch (for example, 100 mm) in the strip-traveling direction, and the tubular nozzles 15 are inclined so as to eject the rod-like flows of cooling water at a predetermined ejecting angle θ (for example, θ=50°) with respect to the traveling direction of a steel strip 12. In the cooler body 10*a* according to the first embodiment, the tubular nozzles in each line are connected to a cooling-water supply pipe 16 via one nozzle header 14, and the cooling-water supply pipes 16 can be independently on-off controlled. In the cooler body 10*b* according to the second embodiment, the tubular nozzles in each two lines are connected to a cooling-water supply pipe 16 via one nozzle header 14, and the cooling-water supply pipes 16 can be independently on-off controlled in control units of the two nozzle lines. The aperture, the ejecting angle, the height, and the like of the tubular nozzles 15 are determined as in the first embodiment.

According to the structure of the cooler body 10*b*, on-off control of the tubular nozzles is performed in the control units of two tubular nozzle lines in the cooler body 10*b*. The on-off control is performed for temperature adjustment after cooling. The control unit (the number nozzle lines) for the on-off control is determined in accordance with a temperature drop achieved by one tubular nozzle line and an acceptable accuracy of the temperature after cooling. With the above-described structure, the steel strip can be cooled by about 1 to 3° C. per tubular nozzle line. When the required temperature accuracy is, for example, ±5° C., the temperature of the steel strip can be in a permissible temperature range if the on-off control can be performed with a resolution of about 5 to 10° C. Therefore, when the temperature of the steel strip is adjusted by 5° C. by the on-off control of one time in this embodiment, the temperature of the steel strip can be adjusted with sufficient accuracy if two tubular nozzle lines can be turned on or off by the on-off control of one cooling-water supply pipe 16. Moreover, when the on-off control is performed in the control units of a plurality of tubular nozzle lines in this manner, the number of isolation valves required for performing the on-off control and the number of pipes can be reduced. Thus, the facility can be built at low cost.

In this embodiment, mechanisms capable of performing the on-off control in the control units of two tubular nozzle lines were described. However, the number of lines serving as the control unit can be increased as long as the required temperature accuracy is maintained. Moreover, the control unit (number of tubular nozzle lines) of an on-off control mechanism can be changed in accordance with the position of the mechanism in the longitudinal direction (strip-traveling direction).

On the other hand, the ejecting nozzles 19 serving as the draining means have a predetermined aperture (for example, inner diameter of 5 mm), and are aligned at a predetermined pitch (for example, 30 mm) downstream of the cooler body 10*b*. The ejecting nozzles 19 eject rod-like flows of cooling water inclined toward the cooler body 10*b* (upstream). The concept similar to the ejecting angle θ of the rod-like flows ejected from the cooler body 10*a* (10*b*) can be applied to the angle η formed between the steel strip 12 and the rod-like flows of cooling water ejected from the ejecting nozzles 19. The angle η is preferably set to 60° or less, and more preferably, 55° or less. When the angle η exceeds 60°, the velocity component of the cooling water (remaining water) in a direction opposite to the strip-traveling direction after the cooling water reaches the steel strip 12 becomes small. With this, the cooling water can interfere with the cooling water ejected from the cooler body 10*b* upstream of the ejecting nozzles, and the flow of the remaining water can be obstructed. This can lead to an outflow of part of the remaining water to a position downstream of the rod-like flows of cooling water ejected from the ejecting nozzles 19, and can lead to instability of the cooling area. Furthermore, the ejecting nozzles 19 eject the rod-like flows of cooling water upstream in the strip-traveling direction. However, the remaining water originally tends to leak in the strip-traveling direction due to a shearing force generated between the steel strip and the remaining water. Therefore, it is preferable that the ejecting angle η is reduced by 5° or more compared with the ejecting angle θ of rod-like flows of cooling water ejected from the cooler body 10*b* disposed upstream of the ejecting nozzles 19 such that the velocity of fluid parallel to the steel strip 12 and opposite to the traveling direction is increased.

Figure 5:
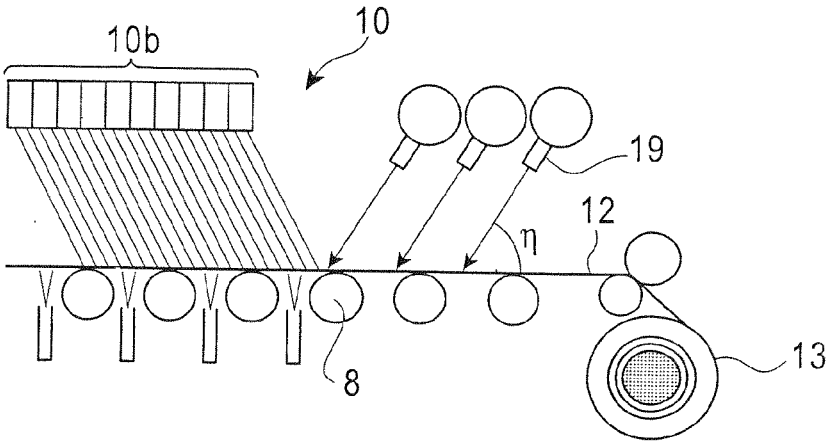
FIG. 5 illustrates the cooling device according to the second embodiment of the present invention in detail.

Moreover, the rod-like flows of cooling water ejected from the ejecting nozzles 19 need to have power to receive the rod-like flows of cooling water ejected from the cooler body 10*b* such that the cooling water does not flow out downstream. Therefore, when the number of in-use lines of the tubular nozzles 15 in the cooler body 10*b* is large, the flow rate, the velocity of flow, and the water pressure of the rod-like flows of cooling water ejected from the ejecting nozzles 19 are preferably increased such that the draining performance is stabilized. Alternatively, as shown in FIG. 5, additional lines (for example, five lines) of the ejecting nozzles 19 serving as the draining means can be provided in the strip-traveling direction, and the number of in-use lines of the ejecting nozzles 19 can be changed in accordance with the number of in-use lines of the tubular nozzles 15 in the cooler body 10*b*.

Since the plurality of ejecting nozzles 19 are aligned in the width direction, gaps can be left between the rod-like flows of cooling water in the width direction, and the remaining water can leak from these gaps. Therefore, when the ejecting nozzles 19 are used, it is preferable that a plurality of lines of the ejecting nozzles 19 are provided in the strip-traveling direction as shown in FIG. 5, and that the positions where the rod-like flows of cooling water in the posterior lines hit the steel strip are shifted from those where the rod-like flows of cooling water in the corresponding anterior lines hit the steel strip in the width direction as in the arrangements of the tubular nozzles 15 of the cooler body 10*a* (10*b*) shown in FIGS. 7, 8A, and 8B. With this, the rod-like flows of cooling water ejected from the posterior lines hit portions between two adjacent rod-like flows in the width direction, at which the draining performance is degraded, and the cooling capacity can be complemented.

In addition, the positions of the cooler body 10*b* and the ejecting nozzles 19 are adjusted such that the rod-like flows of cooling water ejected from the tubular nozzles in the last line (the most downstream line) in the cooler body 10*b* reach the steel strip 12 at positions upstream (for example, 100 mm) of positions where the rod-like flows of cooling water ejected from the ejecting nozzles 19 in the first line (the most upstream line) reach the steel strip 12.

As a result, also in the second embodiment, problems such as variation in cooling capacity in accordance with the existence of the water remaining on the upper surface of the steel strip and unstable cooling capacity in response to changes in the cooling area caused when the cooling water falling on the steel strip freely expands in all directions as in the known cooling device using free-fall flows discharged from the laminar flow nozzles are solved, and a high and stable cooling capacity can be achieved as in the first embodiment. For example, a steel strip having a thickness of 3 mm can be rapidly cooled at a cooling speed of more than 100° C./s.

Moreover, when the steel strip 12 is thin and passage of the steel strip 12 can be instable due to the effect of the cooling water, cooling water can be ejected at an ejecting pressure that does not obstruct the passage of the leading end of the steel strip 12, and the ejecting pressure can be changed to a predetermined value after the leading end of the steel strip is taken up into a coiler. Moreover, when the steel strip is thick (for example, 2 mm or more), the leading end of the steel strip can pass through a portion where cooling water is being ejected in advance. With this, the steel strip 12 can be reliably cooled from the leading end thereof.

In the second embodiment, a case where nozzles that eject rod-like flows of cooling water are used as nozzles for ejecting fluid for drainage serving as the draining means was described. In view of holding back the rod-like flows of cooling water ejected from the cooler body 10*b*, nozzles that eject rod-like flows of cooling water with high momentum are suitable as the draining means. However, the nozzles are not necessarily those ejecting rod-like flows of cooling water, and can be those ejecting tabular slit flows. Moreover, the ejecting speed of the cooling water ejected from the outlets of the nozzles can be less than 7 m/s, and the cooling water can be in a droplet state to some extent instead of having continuity. This is because when the cooling water is used as the draining means, the cooling water needs momentum sufficient to push back the cooling water ejected from the cooler body 10*b*, and does not need to break the water film of the remaining water such that fresh cooling water reaches the steel strip 12 as described in the first embodiment.

In the first and second embodiments, cases where the known cooling device 6 and the cooling device 10 according to the present invention are disposed in this order above the run-out table 5 as shown in FIG. 1 were described. According to the first and second embodiments, the steel strip can be uniformly and stably cooled by the cooling device 10 according to the present invention after the steel strip is cooled by the known cooling device 6 to some extent. Therefore, the cooling stop temperature can be made uniform, in particular, over the length of the steel strip. Moreover, when an existing hot-rolling line is altered, it is only required that the cooling device 10 according to the present invention is added downstream of the known cooling device 6. This can advantageously reduce the cost. However, the present invention is not limited to these embodiments. For example, the known cooling device 6 and the cooling device 10 according to the present invention can be disposed in reverse order. Moreover, only the cooling device 10 according to the present invention can be provided for the line.

Figure 9:
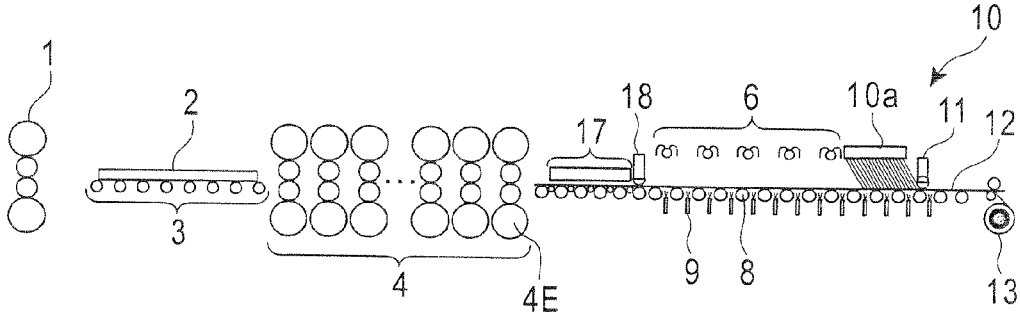
FIG. 9 illustrates a configuration of a rolling facility according to a third embodiment of the present invention.

Furthermore, the present invention can comprehend an embodiment as shown in FIG. 9 (third embodiment). This embodiment corresponds to the first or second embodiment including a cooling device 17 capable of approaching the steel strip for rapid cooling as described in, for example, Patent Document 3 and a pinch roller 18 added between the last finishing stand 43 and the cooling device 6. This facility is suitable for production of dual-phase steel that requires two-stage cooling performed immediately after finishing and immediately before coiling. The known cooling device 6 disposed between the two cooling devices can be used as required. Moreover, the known cooling device 6 is not necessarily provided in some cases.

According to this embodiment, the steel strip 12 can be uniformly cooled from the leading end to the trailing end thereof by the two-stage cooling, and the quality of the steel strip 12 can be stabilized as in the first and second embodiments. With this, cutoff portions of the steel strip can be reduced, resulting in an improvement in the yield.

Example 1

Example 1 of the Present Invention

Figure 8B:
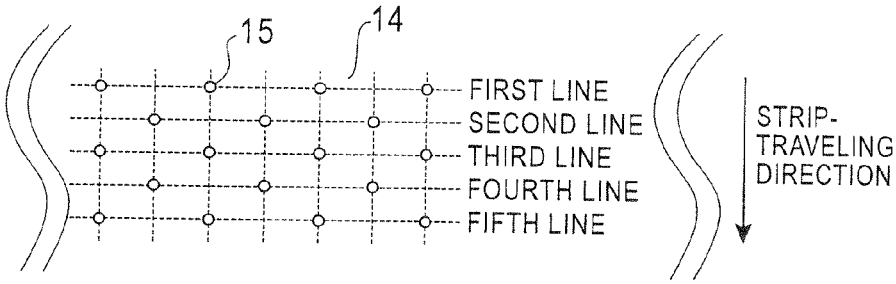

Example 1 of the present invention was performed on the basis of the first embodiment. That is, the facility shown in FIG. 1 was used, on-off control of the rod-like flows of cooling water was performed in the cooler body 10*a* in the control units of one tubular nozzle line as shown in FIG. 3, and the positions of the posterior lines were shifted from those of the corresponding anterior lines by half the pitch of the nozzles in the width direction as shown in FIG. 8B. Moreover, as shown in FIG. 2, the pinch roller 11 was disposed downstream of the cooler body 10*a*.

The thickness of the finished steel strip was set to 2.8 mm. The speed of the leading end of the steel strip at the exit of the continuous finishing stands 4 was set to 700 mpm, and the speed of the steel strip was successively increased up to 1,000 mpm (16.7 m/s) after the leading end of the steel strip reached the down coiler 13. The temperature of the steel strip at the exit of the continuous finishing stands 4 was 850° C., and cooled to about 650° C. using the known cooling device 6. After this, the steel strip was cooled to a target coiling temperature of 400° C. using the cooling device 10 according to the present invention. The allowable temperature deviation of the coiling temperature was set to ±20° C.

At this moment, the ejecting angle θ of the tubular nozzles 15 was set to 50°, and the ejecting speed of the rod-like flows of cooling water ejected from the tubular nozzles 15 was set to 30 m/s. With this, the velocity component of the cooling water hitting the steel strip in the strip-traveling direction was determined as 19.2 m/s (=30 m/s×cos 50°), which exceeded the maximum traveling speed 16.7 m/s of the steel strip. The gap between the pinch roller 11 and the opposing table roller 8 was set so as to correspond to the thickness minus 1 mm (i.e., 1.8 mm) in advance.

The leading end of the steel strip passed under the rod-like flows of cooling water while the cooling water was being ejected under predetermined conditions in advance. When the leading end of the steel strip was nipped by the pinch roller 11 and coiled by the down coiler 13 such that the steel strip was held under tension, the pinch roller 11 was lifted by 2 mm.

Even in this state, almost no cooling water on the steel strip passed downstream through the pinch roller 11, and the pinch roller 11 could achieve a high draining performance. Moreover, no scratches and no loosening of the steel strip were found.

The number of lines of the tubular nozzles 15 that eject the rod-like flows of cooling water was determined on the basis of the traveling speed of the steel strip, the measured temperature of the steel strip, and an amount of temperature to be cooled to a target cooling stop temperature. The tubular nozzles 15 of the determined number of lines adjacent to the pinch roller 11 were set so as to preferentially eject the cooling water. After this, the tubular nozzles 15 that eject the cooling water in the upstream lines were successively used for ejection as the traveling speed of the steel strip 12 was increased.

As a result, the temperature of the steel strip at the down coiler 13 was within 400° C.±10° C. in Example 1 of the present invention. In this manner, the steel strip could be very uniformly cooled from the leading end to the trailing end thereof within the target temperature deviation.

Example 2 of the Present Invention

Example 2 of the present invention was performed on the basis of the second embodiment. That is, a facility substantially the same as that shown in FIG. 1 was used as described above, on-off control of the rod-like flows of cooling water was performed in the cooler body 10*b* in the control units of two tubular nozzle lines as shown in FIG. 6, and the positions of the posterior lines were shifted from those of the corresponding anterior lines by one-third of the pitch of the nozzles in the width direction as shown in FIG. 8A. Moreover, as shown in FIG. 5, a plurality of lines of the ejecting nozzles 19 serving as the nozzles that eject the fluid for drainage were disposed downstream of the cooler body 10*b*.

The thickness of the finished steel strip was set to 2.8 mm. The speed of the leading end of the steel strip at the exit of the continuous finishing stands 4 was set to 700 mpm, and the speed of the steel strip was successively increased up to 1,000 mpm (16.7 m/s) after the leading end of the steel strip reached the down coiler 13. The temperature of the steel strip at the exit of the continuous finishing stands 4 was 850° C., and cooled to about 650° C. using the known cooling device 6. After this, the steel strip was cooled to a target coiling temperature of 400° C. using the cooling device 10 according to the present invention. The allowable temperature deviation of the coiling temperature was set to ±20° C.

At this moment, the ejecting angle θ of the tubular nozzles 15 in the cooler body 10*b* was set to 60°, and the ejecting speed of the rod-like flows of cooling water ejected from the tubular nozzles 15 was set to 35 m/s. With this, the velocity component of the cooling water hitting the steel strip in the strip-traveling direction was determined as 17.5 m/s (=35 m/s×cos 60°), which exceeded the maximum traveling speed 16.7 m/s of the steel strip.

On the other hand, the ejecting angle η of the ejecting nozzles 19 for ejecting rod-like flows of cooling water serving as the draining means was set to 55°. That is, the ejecting nozzles 19 were more inclined than the tubular nozzles 15 in the cooler body lob such that the velocity component of the cooling water opposite to the strip-traveling direction was increased.

The number of lines of the tubular nozzles 15 that eject the rod-like flows of cooling water in the cooler body 10*b* was determined on the basis of the traveling speed of the steel strip, the measured temperature of the steel strip, and an amount of temperature to be cooled to a target cooling stop temperature. The tubular nozzles 15 of the determined number of lines were set so as to preferentially eject the cooling water from the last line (the most downstream line). After this, the tubular nozzles 15 that eject the cooling water in the upstream lines were successively used for ejection in the cooler body 10*b* as the traveling speed of the steel strip 12 was increased. Moreover, the ejecting nozzles 19 were set so as to preferentially eject the cooling water from the first line (the most upstream line), and the volume of water ejected from the ejecting nozzles 19 was increased in accordance with changes in the number of in-use lines of the tubular nozzles 15 in the cooler body 10*b*. When the flow rate from the ejecting nozzles 19 reached the upper limit of the facility, the ejecting nozzles 19 in the downstream lines were successively used for ejection.

At this moment, the leading end of the steel strip passed under the rod-like flows of cooling water while the cooling water was being ejected under predetermined conditions in advance. Even in this state, almost no cooling water on the steel strip passed downstream through the ejecting nozzles 19, and the ejecting nozzles 19 could achieve a high draining performance.

As a result, the temperature of the steel strip at the down coiler 13 was within 400° C.±17° C. in Example 2 of the present invention. In this manner, the steel strip could be very uniformly cooled from the leading end to the trailing end thereof within the target temperature deviation.

Comparative Example

As Comparative Example, a steel strip was cooled without using the cooling device 10 according to the present invention in the facility shown in FIG. 1. At this moment, the steel strip was cooled to a target coiling temperature 400° C. using only the known cooling device 6. The allowable temperature deviation of the coiling temperature was set to ±20° C. Conditions other than these were the same as those in Example 1 of the present invention.

As a result, a cooling temperature hunting phenomenon was found in the steel strip the longitudinal direction thereof in Comparative Example. This can be assumed that water remained in portions of the steel strip warped downward, and caused the unevenness of temperature in the longitudinal direction. Therefore, the temperature of the steel strip at the down coiler 13 widely varied from 300° C. to 420° C. with respect to a target temperature deviation (±20° C.), and as a result, the strength of the steel strip widely varied.

The invention claimed is:

1. A method for cooling a hot steel strip conveyed on a run-out table after a last finishing stand comprising:

(a) ejecting rod-like flows of cooling water from a plurality of cooling nozzles to an upper surface of the steel strip at a speed of 7 m/s or more such that the flows of cooling water are inclined toward a traveling direction of the steel strip having an angle between the steel strip and the flows of the cooling water ejected from the plurality of the cooling nozzles of 60° or less, wherein the plurality of cooling nozzles are arranged in a number of nozzle lines and are positioned after the last finishing stand; and (b) draining the cooling water using a pinch roller disposed downstream of the cooling nozzles, wherein the plurality of cooling nozzles are arranged in a manner such that the plurality of cooling nozzles are provided in a steel strip width direction and that the plurality of cooling nozzles form a plurality of rows in the steel strip traveling direction, and positions of the plurality of cooling nozzles provided in the plurality of rows in said width direction are set in a manner such that the positions in said width direction in an upstream row and the positions in said width direction in an adjacent downstream row are staggered, wherein the cooling nozzles and the pinch roller are placed such that the cooling water ejected from the plurality of the nozzles in a last nozzle line reaches the steel strip at a position upstream of the position where the pinch roller comes into contact with the steel strip while being rotated, and wherein the pinch roller is slightly lifted while the pinch roller is rotated substantially at the same time as when the leading end of the steel strip is taken up into a coiler.

2. The method for cooling a hot strip according to claim 1, wherein a length of a cooling zone is changed such that the cooling capacity is controlled by controlling the number of nozzle lines in the traveling direction of the steel strip.

3. The method for cooling a hot strip according to claim 1, wherein a gap under the pinch roller is set so as to correspond to the thickness of the steel strip or less in advance, and ejection of the cooling water is started substantially at the same time as when the leading end of the steel strip is nipped by the pinch roller.

4. The method for cooling a hot strip according to claim 2, wherein the cooling nozzles that eject the rod-like flows of cooling water inclined toward the traveling direction of the steel strip flow from the cooling nozzles adjacent to the pinch roller, and the length of the cooling zone is changed by successively turning on or off the upstream cooling nozzles during the control of the number of nozzle lines in the traveling direction of the steel strip.

5. The method for cooling a hot strip according to claim 2, wherein a gap under the pinch roller is set so as to correspond to the thickness of the steel strip or less in advance, and ejection of the cooling, water is started substantially at the same time as when the leading end of the steel strip is nipped by the pinch roller.

6. The method for cooling a hot strip according to claim 3, wherein the cooling nozzles that eject the rod-like flows of cooling water inclined toward the traveling direction of the steel strip flow from the cooling nozzles adjacent to the pinch roller, and the length of a cooling zone is changed by successively turning on or off the upstream cooling nozzles during the control of the number of nozzle lines in the traveling direction of the steel strip.

7. The method for cooling a hot strip according to claim 5, wherein the cooling nozzles that eject the rod-like flows of cooling water inclined toward the traveling direction of the steel strip flow from the cooling nozzles adjacent to the pinch roller, and the length of a cooling zone is changed by successively turning on or off the upstream cooling nozzles during the control of the number of nozzle lines in the traveling direction of the steel strip.

* * * * *